US008115794B2

(12) United States Patent
Yoshii et al.

(10) Patent No.: US 8,115,794 B2
(45) Date of Patent: Feb. 14, 2012

(54) OPTICAL SCANNING DEVICE AND IMAGE FORMING APPARATUS

(75) Inventors: Masako Yoshii, Kanagawa (JP); Seizo Suzuki, Chiba (JP); Yoshinori Hayashi, Kanagawa (JP); Daisuke Ichii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 527 days.

(21) Appl. No.: 12/348,110

(22) Filed: Jan. 2, 2009

(65) Prior Publication Data

US 2009/0175657 A1 Jul. 9, 2009

(30) Foreign Application Priority Data

Jan. 9, 2008 (JP) ..... 2008-002513

(51) Int. Cl.
*B41J 27/00* (2006.01)
*B41J 15/14* (2006.01)

(52) U.S. Cl. ..... 347/261; 347/239; 347/241; 347/243; 347/244; 347/255; 347/256; 347/258; 347/259; 347/260

(58) Field of Classification Search ..... 347/243, 347/244, 255, 256, 258, 259, 260, 261
See application file for complete search history.

(56) References Cited

U.S. PATENT DOCUMENTS

| | | | | |
|---|---|---|---|---|
| 4,995,710 | A | | 2/1991 | Suzuki et al. |
| 5,005,928 | A | | 4/1991 | Suzuki et al. |
| 5,355,244 | A | | 10/1994 | Suzuki et al. |
| 5,546,216 | A | | 8/1996 | Suzuki |
| 5,557,448 | A | | 9/1996 | Endo et al. |
| 5,570,224 | A | | 10/1996 | Endo et al. |
| 5,581,392 | A | | 12/1996 | Hayashi |
| 5,606,181 | A | | 2/1997 | Sakuma et al. |
| 5,652,670 | A | | 7/1997 | Hayashi |
| 5,875,051 | A | | 2/1999 | Suzuki et al. |
| 6,034,806 | A | | 3/2000 | Inagaki et al. |
| 6,067,182 | A | * | 5/2000 | Narisawa ..... 359/204.1 |
| 6,069,724 | A | | 5/2000 | Hayashi et al. |
| 6,081,386 | A | | 6/2000 | Hayashi et al. |
| 6,104,522 | A | | 8/2000 | Hayashi et al. |
| 6,185,026 | B1 | | 2/2001 | Hayashi et al. |
| 6,198,562 | B1 | | 3/2001 | Hayashi et al. |
| 6,256,133 | B1 | | 7/2001 | Suzuki et al. |
| 6,330,017 | B1 | | 12/2001 | Suzuki |
| 6,347,004 | B1 | | 2/2002 | Suzuki et al. |
| 6,369,927 | B2 | | 4/2002 | Hayashi |
| 6,384,949 | B1 | | 5/2002 | Suzuki |

(Continued)

FOREIGN PATENT DOCUMENTS

JP 63-199378 8/1988

(Continued)

*Primary Examiner* — Ryan Lepisto
(74) *Attorney, Agent, or Firm* — Dickstein Shapiro LLP

(57) ABSTRACT

In an optical scanning device, when pixel density is taken to be n, number of the light beams is taken to be b, and number of the deflection surfaces of a deflecting unit is taken to be p, a spatial frequency S denoted by $S=1/(1/(25.4/n\times b\times p)$ is within a range of a spatial frequency characteristic for a visual perception system of a high relative luminous efficiency. When spacing between ends in a sub-scanning direction of a scanning line formed by one scan by the deflection unit is taken to be L1, and spacing between all progressive scanning lines at the surface to be scanned is taken to be L2, then $L1>(k-1)\times L2$ is satisfied, where k is a total number of light emitting points of a light source.

8 Claims, 12 Drawing Sheets

U.S. PATENT DOCUMENTS 6,388,792 B1 5/2002 Atsuumi et al.
6,400,391 B1 6/2002 Suhara et al.
6,417,509 B1 7/2002 Atsuumi et al.
6,448,998 B1 9/2002 Suzuki et al.
6,462,853 B2 10/2002 Hayashi
6,509,995 B1 1/2003 Suzuki et al.
6,587,245 B2 7/2003 Hayashi
6,596,985 B2 7/2003 Sakai et al.
6,657,761 B2 12/2003 Suzuki et al.
6,657,765 B2 12/2003 Hayashi et al.
6,757,089 B2 6/2004 Hayashi
6,768,506 B2 7/2004 Hayashi et al.
6,771,296 B2 8/2004 Hayashi et al.
6,771,407 B2 8/2004 Hayashi et al.
6,781,729 B2 8/2004 Suzuki et al.
6,785,028 B1 8/2004 Atsuumi et al.
6,788,444 B2 9/2004 Suzuki et al.
6,791,729 B2 9/2004 Atsuumi et al.
6,803,941 B2 10/2004 Hayashi et al.
6,813,051 B2 11/2004 Suzuki et al.
6,829,104 B2 12/2004 Suzuki et al.
6,833,940 B2 12/2004 Suzuki et al.
6,903,856 B2 6/2005 Hayashi
6,906,739 B2 6/2005 Suzuki et al.
6,934,061 B2 8/2005 Ono et al.
6,956,685 B2 10/2005 Hayashi
6,987,593 B2 1/2006 Hayashi et al.
6,999,208 B2 2/2006 Suzuki et al.
7,006,120 B2 2/2006 Sakai et al.
7,038,822 B2 5/2006 Sakai et al.
7,045,773 B2 5/2006 Suzuki et al.
7,050,082 B2 5/2006 Suzuki et al.
7,050,210 B2 5/2006 Atsuumi et al.
7,061,658 B2 6/2006 Suzuki
7,068,296 B2 6/2006 Hayashi et al.
7,088,484 B2 8/2006 Hayashi et al.
7,088,485 B2 8/2006 Suzuki
7,106,483 B2 9/2006 Hayashi et al.
7,145,705 B2 12/2006 Hayashi
7,167,288 B2 1/2007 Miyatake et al.
7,215,354 B1 5/2007 Sakai et al.
7,218,432 B2 5/2007 Ichii et al.
7,236,281 B2 6/2007 Hayashi et al.
7,253,937 B2 8/2007 Ueda et al.
7,256,815 B2 8/2007 Suzuki et al.
7,271,823 B2 9/2007 Izumi et al.
7,271,824 B2 9/2007 Omori et al.
7,277,212 B2 10/2007 Miyatake et al.
7,333,254 B2 2/2008 Amada et al.
7,362,486 B2 4/2008 Hayashi et al.
7,403,316 B2 7/2008 Amada
7,417,777 B2 8/2008 Saisho et al.
7,443,558 B2 10/2008 Sakai et al.
7,450,274 B2 11/2008 Itabashi et al.
2003/0053156 A1 3/2003 Satoh et al.
2004/0031915 A1* 2/2004 Ito et al. ..... 250/234
2004/0036936 A1 2/2004 Nakajima et al.
2005/0243396 A1 11/2005 Fujii et al.
2006/0232659 A1 10/2006 Hayashi et al.
2006/0245009 A1 11/2006 Akiyama et al.
2006/0284968 A1 12/2006 Hayashi et al.
2006/0285187 A1* 12/2006 Ichii et al. ..... 359/205
2007/0058255 A1 3/2007 Imai et al.
2007/0211324 A1* 9/2007 Sakai et al. ..... 359/213
2007/0211325 A1* 9/2007 Ichii ..... 359/216
2007/0253047 A1* 11/2007 Ichii et al. ..... 359/204
2007/0253048 A1 11/2007 Sakai et al.
2007/0297036 A1 12/2007 Nakamura et al.
2008/0019255 A1 1/2008 Imai et al.
2008/0024849 A1* 1/2008 Hayashi et al. ..... 359/204
2008/0025759 A1* 1/2008 Ichii et al. ..... 399/178
2008/0055672 A1* 3/2008 Watanabe et al. ..... 358/474
2008/0055690 A1 3/2008 Nakamura et al.
2008/0055692 A1* 3/2008 Saisho et al. ..... 359/205
2008/0062491 A1 3/2008 Nakamura et al.
2008/0068689 A1 3/2008 Saisho et al.
2008/0068690 A1* 3/2008 Ichii ..... 359/204
2008/0068693 A1* 3/2008 Hayashi et al. ..... 359/204
2008/0100895 A1* 5/2008 Hayashi et al. ..... 359/204
2008/0123159 A1* 5/2008 Hayashi et al. ..... 358/474
2008/0180772 A1 7/2008 Miyatake et al.
2008/0192319 A1 8/2008 Miyatake et al.
2008/0204840 A1 8/2008 Watanabe et al.
2008/0204841 A1 8/2008 Suzuki et al.
2008/0204842 A1 8/2008 Arai et al.
2008/0204852 A1 8/2008 Amada et al.
2008/0212999 A1 9/2008 Masuda et al.
2008/0218827 A1 9/2008 Watanabe et al.
2008/0219601 A1 9/2008 Arai et al.
2008/0247021 A1* 10/2008 Ichii ..... 359/204
2008/0266633 A1 10/2008 Hirakawa et al.
2008/0267662 A1 10/2008 Arai et al.
2008/0267663 A1 10/2008 Ichii et al.
2008/0284838 A1 11/2008 Suzuki et al.
2008/0285104 A1 11/2008 Arai et al.

FOREIGN PATENT DOCUMENTS

JP 10-253904 9/1998
JP 2003-205642 7/2003
JP 2004-287292 10/2004
JP 2005-250319 9/2005
JP 2006-215270 8/2006
JP 2007-196460 8/2007
JP 2008-107554 5/2008
JP 2008-129490 6/2008

* cited by examiner

PATTERN 1
4-SURFACE PERIOD

VARIOUS WRITING METHODS
(VCSEL JUMP METHOD 1)

PATTERN 2
4-SURFACE PERIOD

VARIOUS WRITING METHODS
(VCSEL JUMP METHOD 2)

PATTERN 3
4-SURFACE PERIOD

VARIOUS WRITING METHODS
(VCSEL NEIGHBORING METHOD)

PATTERN 4
6-SURFACE PERIOD

VARIOUS WRITING METHODS
(MULTI-LASER DIODE METHOD)

OPTICAL SCANNING DEVICE AND IMAGE FORMING APPARATUS

CROSS-REFERENCE TO RELATED APPLICATIONS

The present application claims priority to and incorporates by reference the entire contents of Japanese priority document 2008-002513 filed in Japan on Jan. 9, 2008.

BACKGROUND OF THE INVENTION

1. Field of the Invention

The present invention relates to an optical scanning device for use in an image forming apparatus such as a printer, facsimile, or plotter having the optical scanning device, and a multifunction product equipped with at least one such apparatus.

2. Description of the Related Art

Image forming methods using lasers as image forming units to obtain high-quality images are widely employed in electro-photographic image recording. Methods where an axial direction of a photosensitive drum in the case of electrophotography is scanned by a laser (main scanning) using a polygon mirror and the drum is then rotated (sub-scanning) to form a latent image are typical.

High-density images that are output at high speed can be obtained by employing these methods. The relationship between high-density and the output speed of images is a trade-off. It would actually be preferable to achieve both high-density and high output speed.

High-speed rotation of a polygon scanner has been considered as a way of achieving both of these purposes. However, rotating the polygon scanner at high speed causes increase in the noise and power consumption, and is detrimental to durability.

Adopting a multi-beam approach is one approach to take care of these issues and the following forms can be considered for this method:

a) A method of employing a plurality of end-emitting laser diodes (a method that has been disclosed in Japanese Patent Application Laid-open No. 2005-250319, etc.), b) A method employing a one dimensional array of end-emitting laser diodes, and c) A method employing a two-dimensional laser diode array.

The method of employing a plurality of end-emitting laser diodes is relatively inexpensive because it is possible to use general-purpose one-dimensional laser diodes. However, it is difficult to stably maintain a relative positional relationship between the laser diodes and coupling lenses, i.e., it is difficult to stably maintain a relative positional relationship between the beams emitted from the laser diodes. If such a relative positional relationship is not maintained, spacing of scanning lines formed on a surface being scanned by multiple beams becomes irregular leading to degradation of image quality.

In this method, it is also difficult to have an extremely large number of light sources and achieving ultra-high-density and ultra-high speeds is difficult.

It is possible to make the scanning line spacing for an end-emitting one-dimensional laser diode array uniform but this leads to increase in the power consumption. If the number of beams is made extremely large any way, an extent of deviation of beams from optical axes of optical elements of an optical system becomes substantial and optical characteristics are degraded.

On the other hand, as shown in FIG. 13, a surface emitting laser (VCSEL: Vertical Cavity Surface Emitting Laser) is a semiconductor laser that emits light in a vertical direction with respect to a substrate. This means that two-dimensional integration is straightforward. The electrical power consumed is in the order of one decimal place smaller compared to an end surface type laser. A larger number of light sources can therefore be integrated two-dimensionally.

A vertical cavity surface emitting laser that emits light vertically with respect to a semiconductor substrate surface has the following advantages compared to end surface emitting lasers of the related art. The volume of the active layer can be made small. Driving at a current of a low threshold value and low power consumption is therefore possible. The mode volume of an oscillator is also small so that modulation of a few tens of GHz becomes possible, which makes high speeds possible. An angle of spread of emitted light is also small and connection with optical fibers is therefore straightforward. Surface emitting lasers also do not require narrow openings to be manufactured. The surface area of the elements is therefore small. It is therefore possible to make a parallel, two-dimensional high-density array.

Examples of writing optical systems that employ a polygon mirror to perform scanning are given in Japanese Patent Application Laid-open No. 2004-287292 and Japanese Patent Application Laid-open No. 2008-107554.

Two-dimensional arraying of surface emitting laser diodes is straightforward and it is possible to increase the number of beams compared to end emitting laser diodes.

On the other hand, achieving a high output with a surface emitting laser diode is difficult. Moreover, when the spacing between surface emitting laser elements is too narrow, the lifespan of a light source is dramatically shortened due to thermal interference. In addition, arrangement of electrical wiring also becomes difficult when the spacing between surface emitting laser elements becomes too narrow. Methods that lower an absolute value for sub-scanning lateral magnification of an entire optical system with respect to a sub-scanning direction exist for broadening the spacing between elements of a surface emitting laser. However, conversely, when the absolute value for sub-scanning lateral magnification is lowered, optical utilization efficiency is also lowered and it is therefore necessary to increase the output of the light source. This is not an effective way of improving the lifespan of the light source.

The following is an explanation of a reciprocity law failure that occurs when writing at high-density.

Typical image forming units and apparatus such as copiers, printers, facsimiles, or multifunction products that are combinations thereof form images on an image carrier using the following means.

First, a region corresponding to an image pattern on an image carrier surface electrostatically charged by a charging unit such as a corona charger or a charging roller is irradiated with a light beam so as to form a latent image on the surface. Toner is then electrostatically affixed to the latent image by an exposure unit so as to form a toner image.

Forming of the latent image on the image carrier carried out here utilizes the characteristics whereby a latent image is formed when a charge load is attenuated as a result of a charged photoconductor being exposed to light so as to generate carriers within the image carrier. A PIDC (Photo-Induced Decay Curve) indicating an extent of attenuation of charge potential with respect to exposure energy shows a characteristic for each photoconductor. FIG. 14 explains an example of a PIDC.

The PIDC is decided for every photoconductor but the potential of the surface of the photoconductor after irradiation with a light beam is different depending on the way irradiation takes place even in the case of irradiation with a light beam of the same quantity of optical energy.

For example, with a mutual difference between a fall in potential of a photoconductor surface when the surface of the photoconductor is irradiated just once with a light beam having an optical energy of a certain quantity and a fall in potential of a photoconductor surface when irradiated twice with a light beam of an optical energy half of the aforementioned optical energy, an absolute value for the potential of the surface of the photoconductor falls substantially.

This is a typical phenomenon known in the related art as reciprocity. This phenomenon is discussed in Japanese Patent Application Laid-open No. 2003-205642.

This reciprocity law failure can be seen in image forming methods and apparatus that employ multi-beam scanning exposure methods. In a multi-beam scanning exposure method, when a plurality of laser diode light sources are lined up, the number of which is taken to be N, N-multi-beam lines are simultaneously exposed on the photoconductor when exposure in a main scanning direction is carried out one time using one surface of a rotating polygon mirror.

Each beam is elliptical and the adjacent beams partially overlap with each other. This means that a greater power than normal can be achieved with one exposure. When N multi-beam lines are then scanned to expose the next surface of the polygon mirror, scanning and exposure is such that beams for a final line one previous (Nth) and a first line (1st) on this occasion partially overlap. Exposure then takes place with this strong power being separated into two times.

In practical terms, in a multi-beam optical system, there are therefore cases where the same exposure imaging is incurred one time at one point on the photoconductor, and cases where the exposure energy is incurred divided into two times, even when the exposure energy provided to the photoconductor is the same. It is also possible for the effects to be different depending on the photoconductor at this time even when the same exposure energy is incurred. This is to say that the so-called reciprocity law failure occurs.

A PIDC for this time is shown in FIG. 15. A PIDC is shown in FIG. 15 where solid lines show the case where exposure takes place with the same exposure energy separated into two times ("sequential exposure" in the following), and dashed lines show the case of exposure one time ("simultaneous exposure" in the following).

When the images of dots (or lines) are formed using a plurality of beams, it can be understood that image defects referred to as "image irregularities" where the density and thickness of dots (or lines) that are formed by simultaneous scanning and exposure or sequential exposure of a plurality of beams change for a photoconductor of strong reciprocity.

It is also possible that density variation referred to as banding or a Moire pattern will be recognizable by a person depending on the size of the frequency of the image irregularities.

An explanation is now given of visual perception characteristics of a person.

When the image data is considered as the drawing of the distribution of density and brightness etc., this distribution can be perceived as a wave. Considering a pattern (wave) where light and dark are alternately repeated, it is possible to consider this repeating as a frequency. This frequency is typically referred to as spatial frequency.

When the spatial frequency is high, the width of the light and dark pattern becomes narrow. An MTF (Modulation Transfer Function) exists for denoting the relationship between spatial frequency and contrast (LD (Light-Dark) ratio). Visual perception characteristics of a person where spatial frequency f and contrast sensitivity MTF of a visual perception system are put into graphic form is shown in FIG. 16.

$$VTF(u)=5.05\exp(-0.138u)\{1-\exp(-0.1u)\} \quad (1)$$

where u is spatial frequency [cycle/degree]

It is necessary to process this image taking into consideration the characteristic that "perception becomes difficult towards the high-frequency side, but recognition becomes easier towards the low-frequency side".

When variation in the sub-scanning frequency exists in regions that are perceptible to the human eye, when image forming is carried out using a multi-beam scanning method employing a plurality of beams to achieve high image quality and high speeds, there is the fear of writing being recognized as a direct Moire pattern.

SUMMARY OF THE INVENTION

It is an object of the present invention to at least partially solve the problems in the conventional technology.

According to an aspect of the present invention, there is provided an optical scanning device including a light source of surface emitting lasers arrayed two-dimensionally that emits a plurality of light beams; a first optical system that guides the light beams from the light source in a first direction; a deflection unit having a plurality of deflection surfaces that receive the light beams guided by the first optical system and deflect the light beams in a second direction; and a second optical system that guides the light beams deflected by the deflection unit toward a surface to be scanned. When pixel density is taken to be n, number of the light beams is taken to be b, and number of the deflection surfaces is taken to be p, a spatial frequency S denoted by $S=1/(1/(25.4/n\times b\times p)$ is within a range of a spatial frequency characteristic for a visual perception system of a high relative luminous efficiency. When spacing between ends in a sub-scanning direction of a scanning line formed by one scan by the deflection unit is taken to be L1, and spacing between all progressive scanning lines at the surface to be scanned is taken to be L2, then $L1>(k-1)\times L2$ is satisfied, where k is a total number of light emitting points of a light source.

According to another aspect of the present invention, there is provided an image forming apparatus including an image carrier; and the above optical scanning device that forms a latent image on a surface of the image carrier by scanning the surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
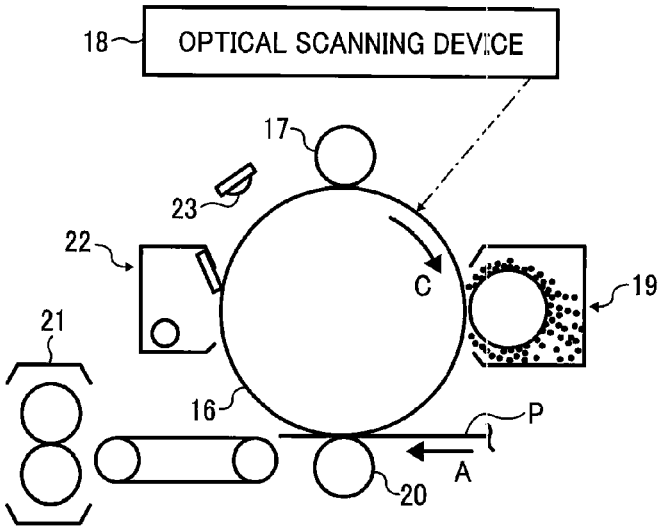
FIG. 1 is an outline view of an image forming apparatus of a first embodiment of the present invention.

Exemplary embodiments of the present invention are explained in the following with reference to the drawings.

First, an explanation is given of a first embodiment based on FIGS. 1 to 8. An outline of a configuration of an image forming apparatus of the first embodiment is explained by using FIG. 1. The image forming apparatus shown here includes an image carrier that is a drum-shaped photoconductor 16. The photoconductor 16 is rotated in a clockwise direction in FIG. 1. As a result, the surface of the photoconductor 16 moves in a direction of an arrow C. At this time, the surface of the photoconductor 16 is charged to a prescribed polarity by a charging device 17. The photoconductor 16 is charged to, for example, a negative polarity. The charged surface of the photoconductor 16 is subjected to image exposure by an optical scanning device 18. An electrostatic latent image is then formed on the photoconductor 16.

This electrostatic latent image is then developed into a visible toner image by a developing device 19 by application of toner to electrostatic latent image. The toner image is then electrostatically transferred to a transfer material P fed in the direction of an arrow A from a paper feeding device (not shown) by the action of a transfer device 20. The transfer material P to which the toner image is transferred passes through a fixing unit 21 where the toner image is fixed to the transfer material P as the result of the application of heat and pressure.

Residual toner still fixed to the surface of the photoconductor 16 even after the transfer of the toner image to the transfer material P is then removed by a cleaning unit 22. The cleaned surface of the photoconductor 16 is then irradiated with charge removing light by a destaticizing lamp 23 so that a surface potential of the photoconductor 16 is initialized.

The toner image formed on a photoconductor 60 is directly transferred onto the transfer material P. It is also possible, however, for the toner image on the photoconductor 16 to be transferred to a transfer material that is an intermediate transfer body, with the toner image on the intermediate transfer body then being transferred to a final transfer material.

Deployment of a plurality of the developing devices, the photoconductors, and the peripheral equipment in a color image forming apparatus is also possible.

Figure 2:
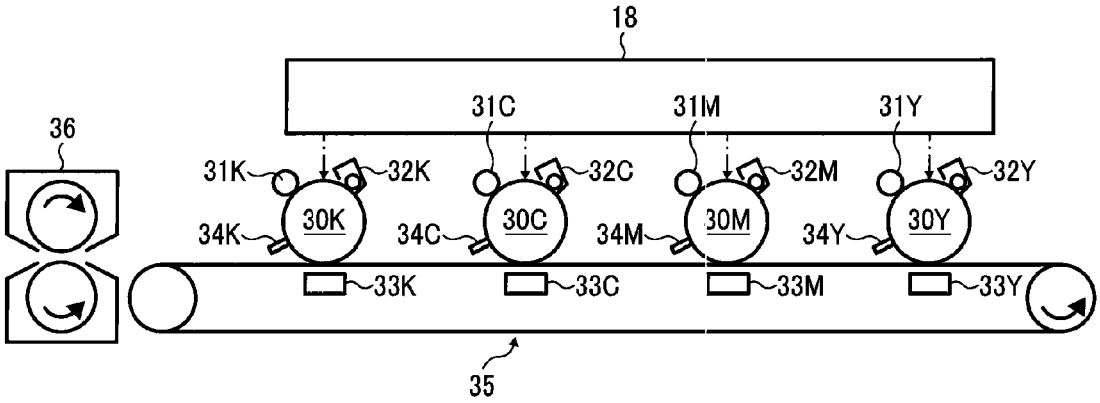
FIG. 2 is an outline view of a multicolor image forming apparatus.

An example of a tandem type direct transfer method is shown in FIG. 2. Photoconductors 30Y, 30M, 30C, 30K rotate in the clockwise direction. Chargers 31Y, 31M, 31C, 31K, developers 32Y, 32M, 32C, 32K, transfer charging units 33Y, 33M, 33C, 33K, and cleaning units 34Y, 34M, 34C, 34K are then disposed in order of rotation.

The chargers 31Y, 31M, 31C, 31K are charging members constituting charging unit for uniformly charging the surfaces of the photoconductors. A beam is irradiated by the optical scanning device 18 onto the surface of the photoconductors between the charging members and the developers 32Y, 32M, 32C, 32K so as to form electrostatic latent images on the photoconductors. Toner images are then formed on the surfaces of the photoconductors by the developers based on the electrostatic latent images. Toner images for each color are then sequentially transferred to transfer material conveyed by a transfer conveyor belts 35 by the transfer charging units 33Y, 33M, 33C, 33K. Images are then finally fixed to the transfer material by a fixing unit 36.

Figure 3:
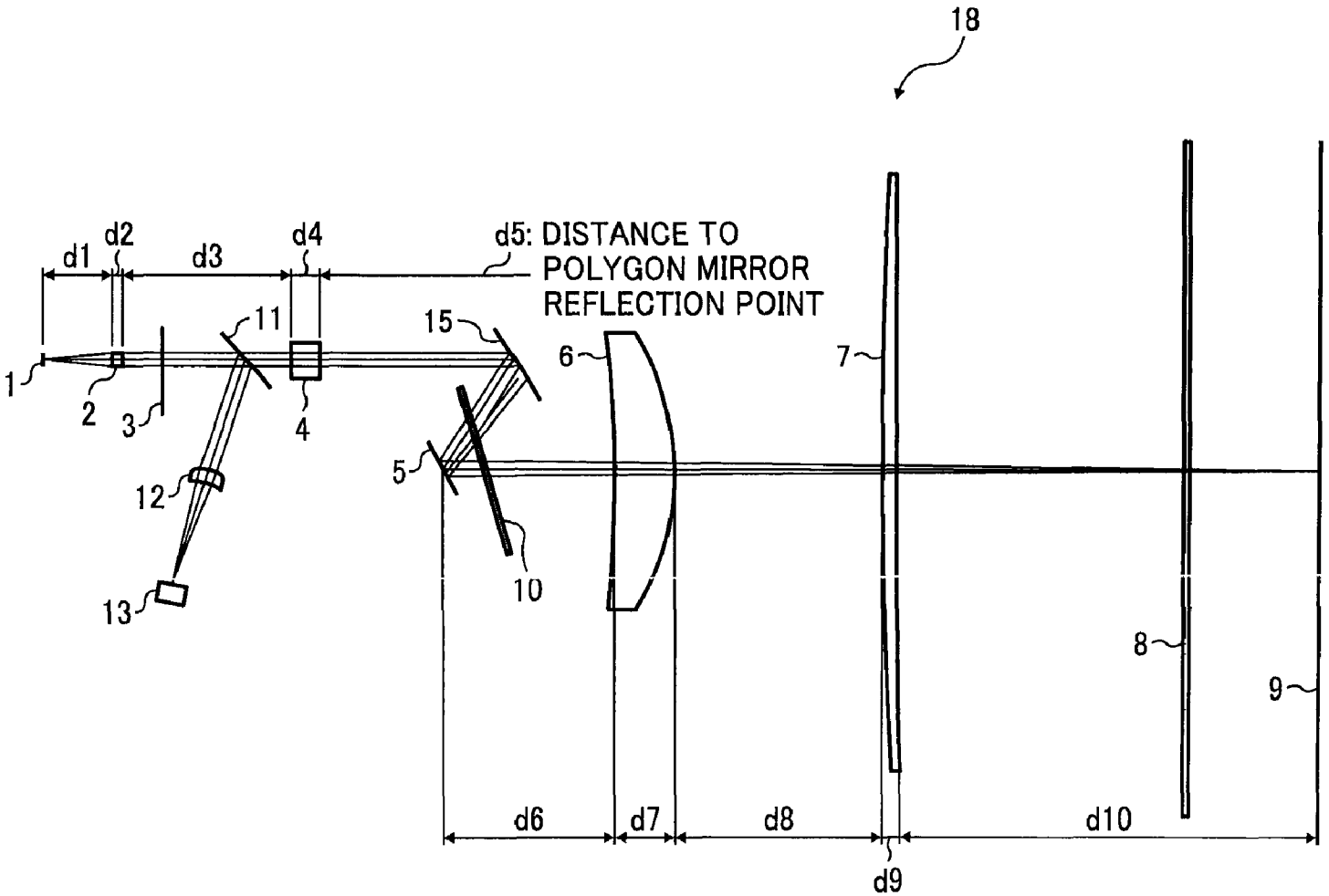
FIG. 3 is an outline view of a main scanning cross-section of an optical scanning device.

An outline of the optical scanning device 18 is shown in FIG. 3. A light source 1 is a semiconductor laser including surface emitting lasers arrayed two-dimensionally. Luminous flux emitted by the light source 1 is made parallel by a coupling lens 2 before passing through an aperture 3. The luminous flux is then focused onto the vicinity of a polygon mirror 5 that is a deflection unit for the sub-scanning direction by a cylindrical lens 4. Numeral 15 denotes a dummy mirror.

The first optical system includes the coupling lens 2, the aperture 3, and the cylindrical lens 4.

The luminous flux is then deflected by the polygon mirror 5 and is passed through dustproof glass 8 by a deflector side scanning lens 6 and an image side scanning lens 7 so as to form an image surface (surface to be scanned) 9. Dustproof glass 10 is provided between the polygon mirror 5 and the deflector side scanning lens 6.

The light source 1 and the coupling lens 2 are fixed to a member of the same material of aluminum. A half-mirror (where a light splitting ratio is set to, for example, 9:1, 8:2, or 7:3 to make the ratio of the beams directed towards the photoconductor large) 11 is provided between the aperture 3 and the cylindrical lens 4. A reflected side beam is then guided to a photodiode 13 via an image forming lens 12.

Explanation of VCSEL

It is therefore possible to provide an image forming apparatus compatible with high-density and high speeds by using a surface emitting laser (Vertical Cavity Surface Emitting Laser (VCSEL)) at the light source 1 within the optical scanning device 18. A VCSEL is a semiconductor laser that emits light in a direction perpendicular to a substrate for which two-dimensional integration is straightforward. The electrical power consumed is in the order of one decimal place smaller compared to an end surface type laser. This has the benefit that a larger number of light sources can be integrated two-dimensionally.

For example, when a VCSEL is mounted and writing is carried out at:

Resolution: 4800 dpi

Number of Laser Diodes: 40

Number of Polygon Diffraction Surfaces: 4 a length L in the sub-scanning direction for a one-time scan by the polygon mirror 5 becomes L=25.4/4800×40×4=0.8467 millimeters.

Because unevenness occurs in a sub-scanning direction in scanning units, a period S for sub-scanning variation becomes S=1/(25.4/4800×40×4)=1/0.8467=1.18 cycles/cm.

When this period is adapted for relative luminous efficiency for a person, the variation can be easily confirmed in regions where the sensitivity is the highest. It is therefore possible that the banding will result in failed images if the variation for this sub-scanning direction is not reduced.

A configuration satisfying the following is adopted for this embodiment when spacing between both ends of scanning lines for the sub-scanning direction formed by one scan of the polygon mirror 5 is taken to be L1 and spacing (width of one scanning line in the sub-scanning direction) of all of the progressive scanning lines at the surface to be scanned 9 is taken to be L2:

$$L1>(k-1)\times L2$$

Here, k is a total number for the number of the light emitting points of the light source.

Figure 4:
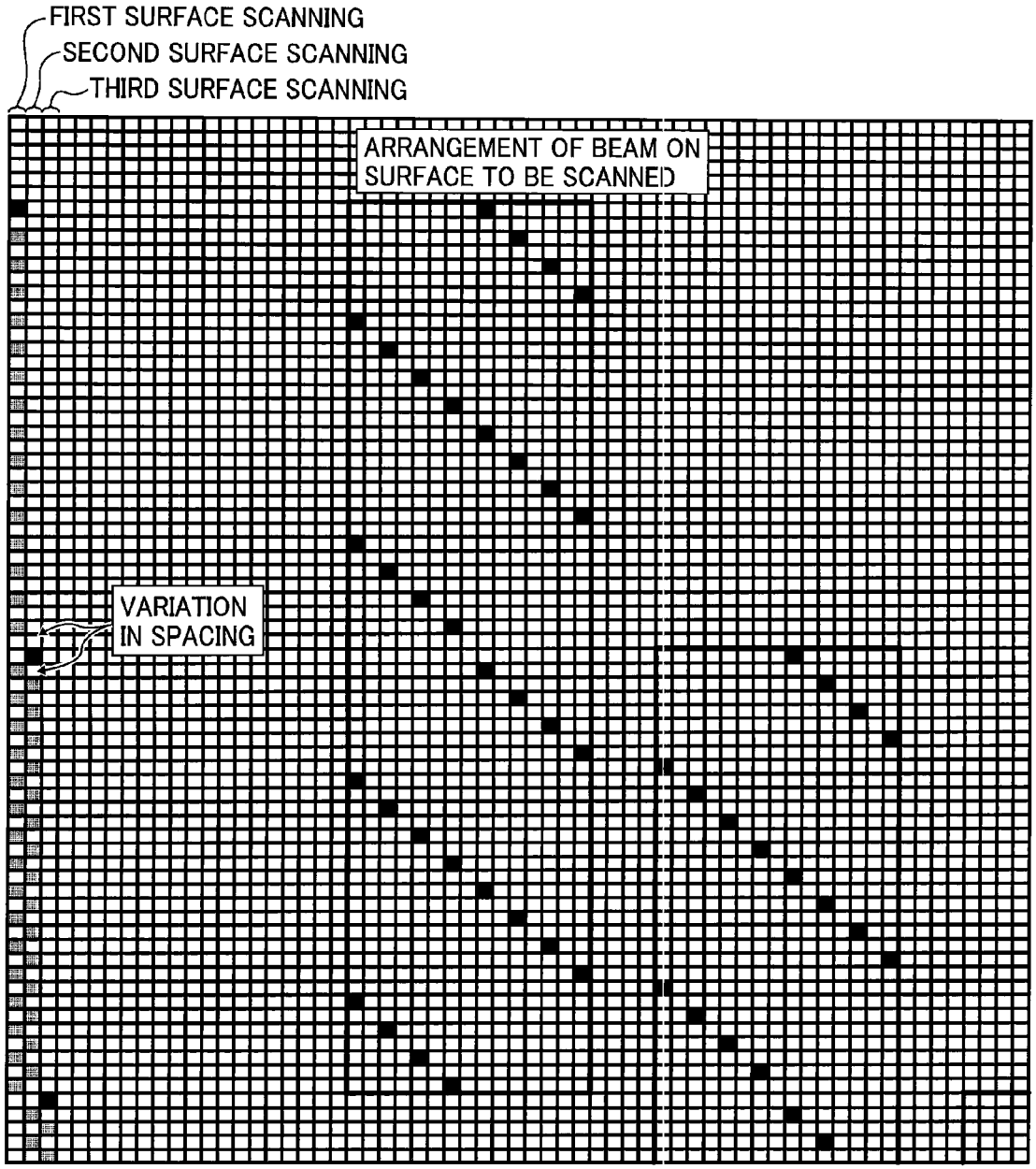
FIG. 4 is a view explaining interlaced scanning.

Specifically, as shown in FIG. 4, interlaced scanning is carried out.

Progressive scans and scans for multi-laser diodes are compared for variation in density when interlaced scanning is carried out and image density variation is evaluated depending on the writing method.

Figure 5A:
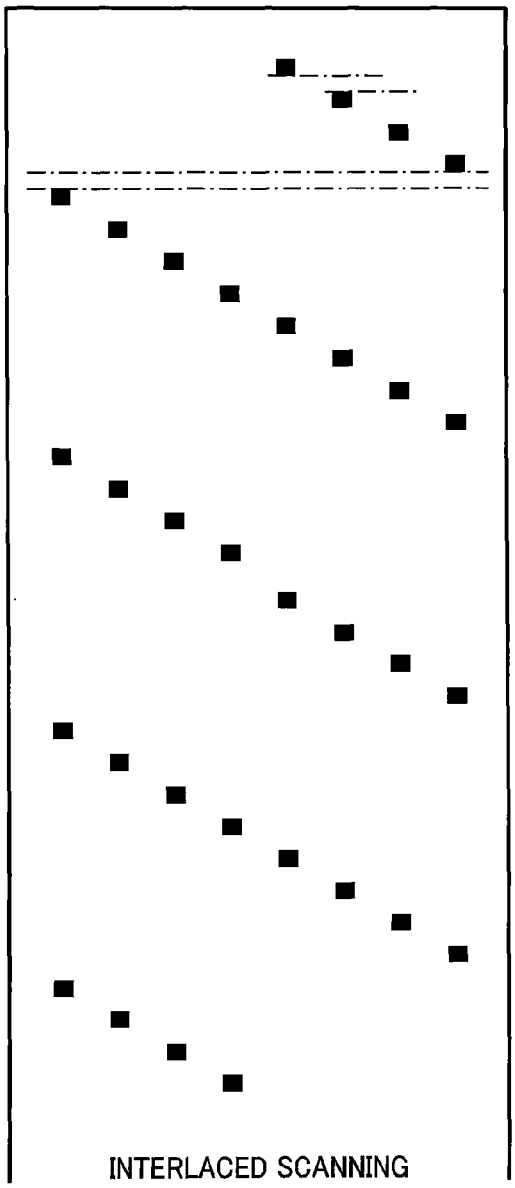
FIGS. 5A and 5B are diagrams for explaining examples of writing using scanning methods where FIG. 5A explains a interlaced scanning method and FIG. 5B explains a progressive scanning method.
Figure 5B:
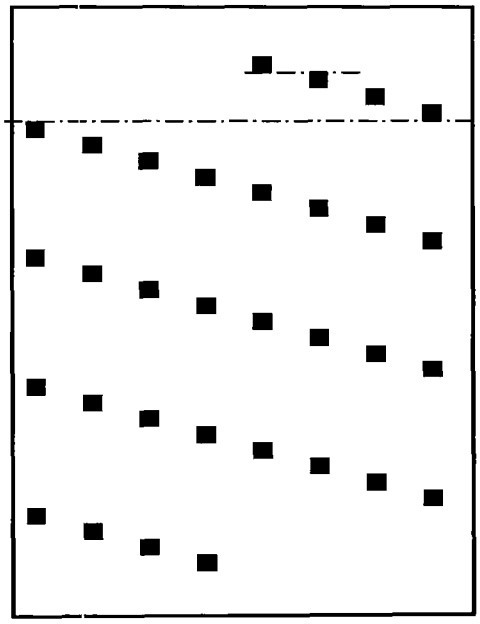
Figure 6:
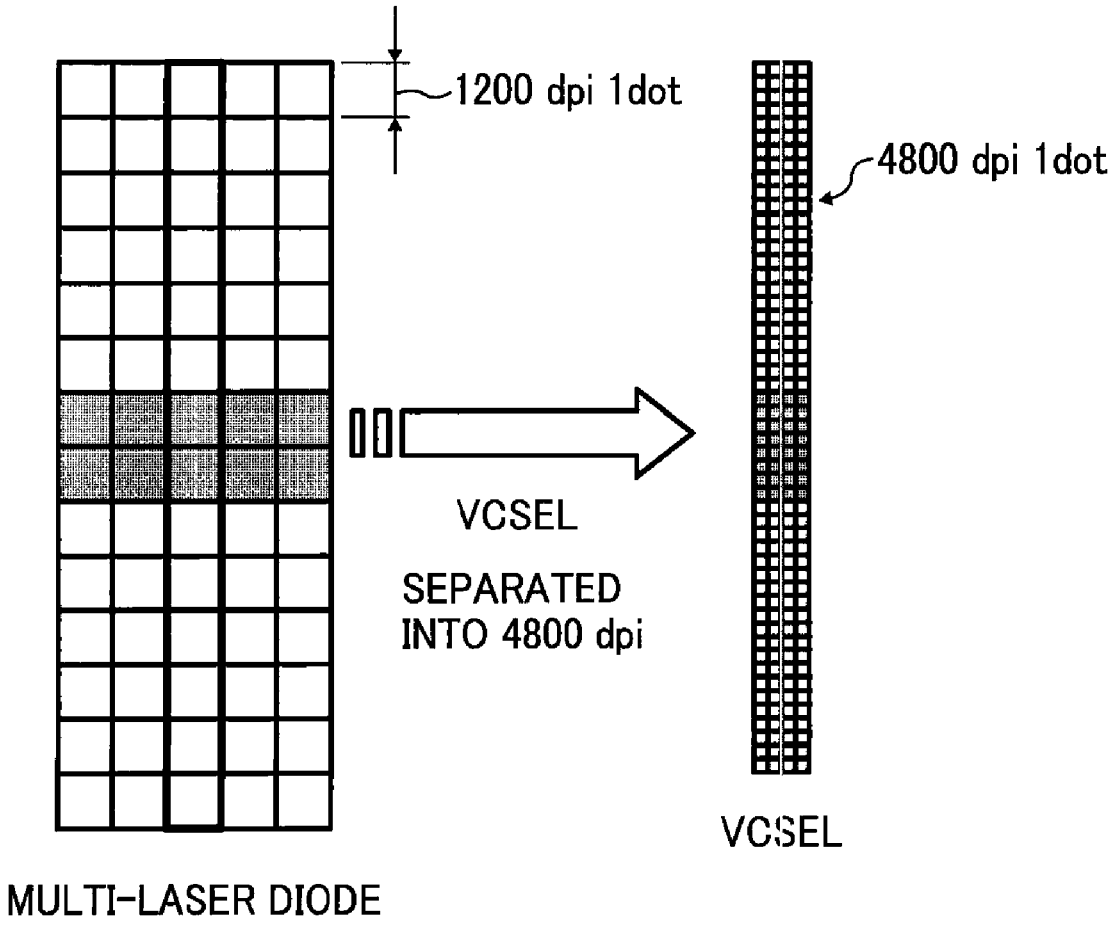
FIG. 6 is a diagram for explaining an evaluation image for evaluating variation in density for each writing method.

Examples of interlaced scanning (a) using VCSEL and progressive scanning are shown in FIGS. 5A and 5B. Compared to progressive scanning, interlaced scanning is a method where spacing between progressive scanning lines is broadened and images are formed by scanning a plurality of times.

The variation in density occurring for each writing method is then evaluated. A 1200 dpi, 2-dot horizontal image (refer to FIG. 6) for which latent image differences appear easily is evaluated as an evaluation image.

Writing resolution is different for the multi-laser diodes at 1200 dpi and the VCSEL at 4800 dpi. The laser diodes are therefore illuminated in such a manner that evaluation images become the same. As can be understood from FIG. 6, two dots are illuminated for the multi-laser diode and eight dots are illuminated for the VCSEL.

Figure 7:
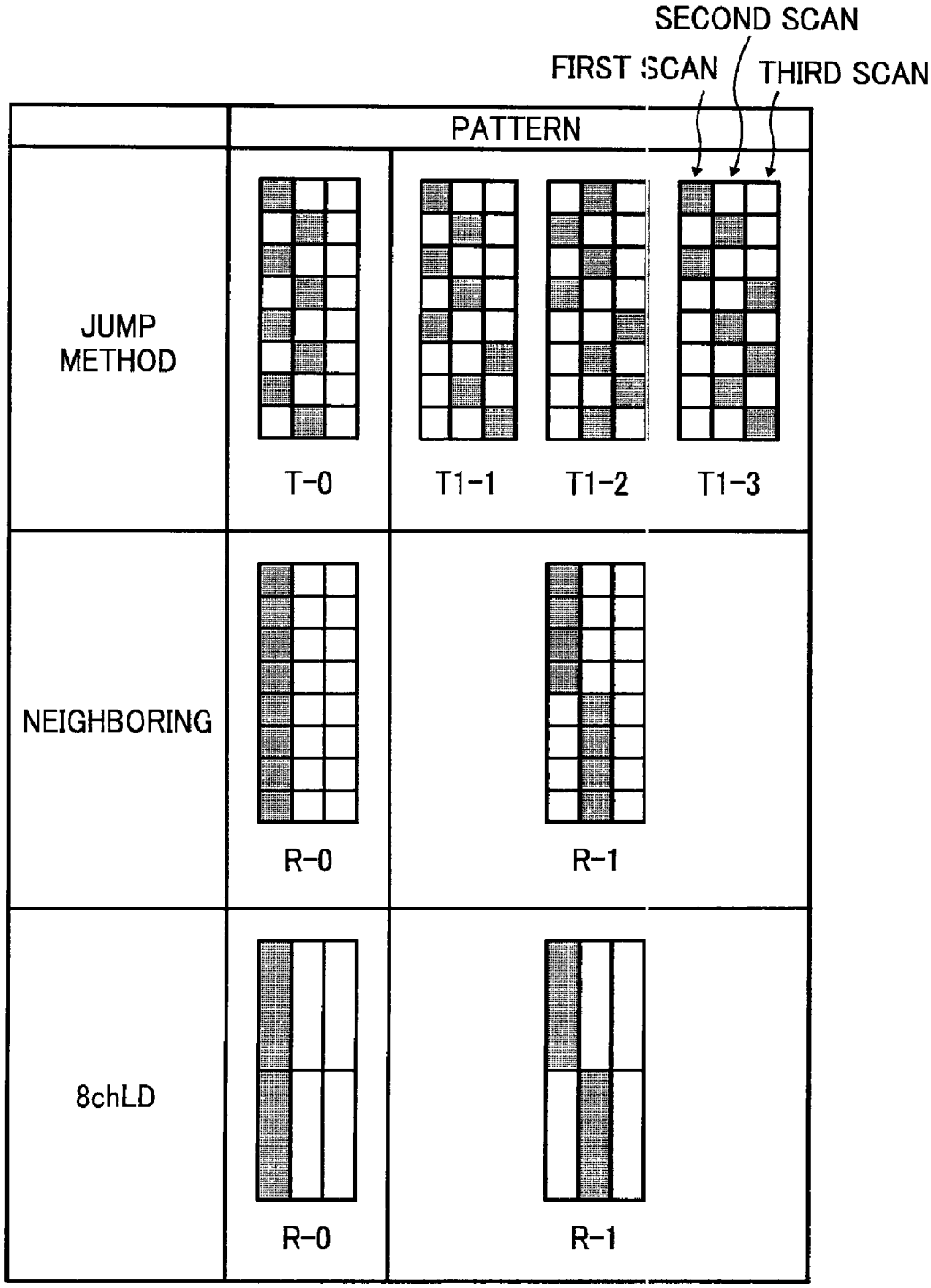
FIG. 7 is a diagram for explaining an example of 1200 dpi, 2-dot line scanning of each writing method.

The number of times of scanning is therefore different depending on the writing method and the writing positions of the laser diodes (including a central part of the VCSEL, or the ends, i.e. the switching of scanning) during exposure of the evaluation image. An example is shown in FIG. 7. A vertical side of each pattern is the sub-scanning position and the horizontal side is the scanning number.

For example, in progressive scanning, 8 lines are normally simultaneously lit but this extends only to scans in the case of the ends. Similarly, with the multi-laser diodes, two lines are normally simultaneously lit but in the case of the ends, lighting occurs extended over two scans.

Variation in density then occurs due to reciprocity when the number of scans is different. The occurrence of the variation in density then occurs at periods where visual perception is high as described previously.

When the scanning spacing is broadened and an image is formed using a plurality of scans as with the interlaced scanning, light intensity is low, and an image is therefore formed using a plurality of scans. Variations in density occurring at the ends of the laser diodes therefore become small.

Figure 8:
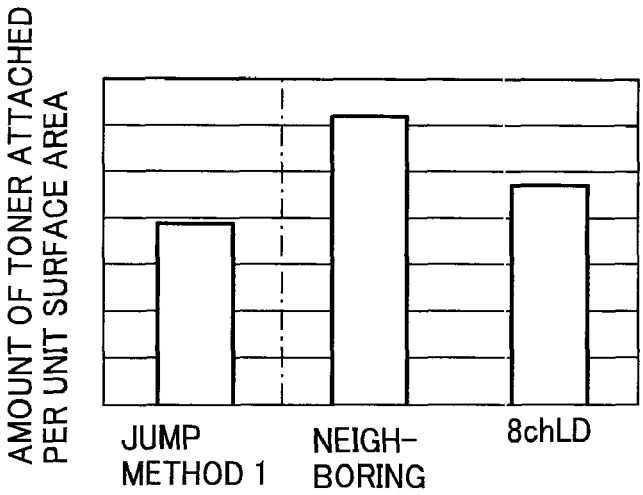
FIG. 8 is a graph for explaining differences in amounts of toner that become affixed in each writing method.

The results of this comparison are shown in FIG. 8. This is a comparison of the difference between an amount of toner that becomes affixed in the vicinity where the variation occurs and the amount of toner that becomes affixed elsewhere. It can be confirmed that a small value means that the density variation is slight and that interlaced scanning gives images with the smallest density variation.

The spatial frequency of the variation is of course high at regions where the relative luminous efficiency is high and write precision has to be sufficiently satisfied. When the pixel density is low, the number of beams is high, and the number of polygon surfaces is large, pitch in a sub-scanning direction becomes large and the spatial frequency of the variation becomes low. When pitch in the sub-scanning direction becomes too large, the beam spacing in a sub-scanning direction of the lens becomes large. It is then difficult to make the beam spot of a small diameter and it is difficult to stabilize the beam pitch.

For example, pitch in the sub-scanning direction is 0.846 millimeters (a spatial frequency of 0.85) when the pixel density is 4800 dpi, the beam number is 40, and the polygon surface number is 4, so as to give writing satisfying a beam spot diameter of an allowable tolerance of 50 micrometers. However, pitch in the sub-scanning direction becomes 2.0 millimeters (a spatial frequency of 0.49) when, for example, the pixel density is 2400 dpi, the beam number is 32, and the number of polygon surfaces is 6. The allowable tolerance for the beam spot is then not satisfied. Writing precision can be achieved during interlaced scanning when the spatial frequency is 0.70 or more.

When the pixel density becomes high, the number of beams becomes small, and the number of polygon surfaces becomes small, pitch in a sub-scanning direction also becomes small and the spatial frequency of the variation becomes high. When pitch in the sub-scanning direction becomes too small, the write frequency increases, the polygon mirror needs to be rotated faster which makes practical implementation impossible.

For example, when the pixel density is 4800 dpi, the number of beams is 40, and the number of polygon surfaces is 4 (the spatial frequency is 0.85 cycles/millimeter), the write frequency is 204 MHz, and rotational speed of polygon mirror is in the order of 20,000 rpm. However, when the number of beams is reduced to 22, the spatial frequency becomes 2.1 cycles/millimeter, the write frequency becomes 372 MHz, and the rotational speed of the polygon mirror becomes fast at 40,000 rpm. Problems with heat and noise therefore arise that make implementation difficult. It is therefore preferable for the spatial frequency to be 2.0 cycles/millimeter or less.

When spacing between the ends in a sub-scanning direction for a scanning line formed by one scan by the deflection unit is taken to be L1, and spacing between all progressive scanning lines at the surface to be scanned is taken to be L2, then:

$$L1>(K-1)\times L2$$

is satisfied. This means that by implementing interlaced scanning, it is also possible to reduce variation in density in optical methods where the variation in density is striking such as when the spatial frequency S=1/(25.4/pixel density×number of beams×number of polygon surfaces) is $0.7 \leqq S \leqq 2.0$.

The VSCSEL is high-resolution and therefore has the following problems:

When the spacing of surface emitting laser elements becomes too narrow, the lifespan of the light source becomes markedly short due to thermal interference. Arrangement of electrical wiring becomes difficult when the spacing between surface emitting laser elements becomes too narrow.

Methods that lower the absolute value for sub-scanning lateral magnification of an entire optical system with respect to a sub-scanning direction exist for broadening the spacing between elements of a surface emitting laser. Unfortunately, it then becomes necessary to make the light source high output because light utilization efficiency conversely falls as the sub-scanning lateral magnification absolute value falls. This is therefore not effective with respect to the lifespan of the light source.

However, it is possible to broaden light source spacing without lowering light utilization efficiency by using interlaced scanning. The lifespan of the light source can therefore be lengthened and the degree of freedom with respect to electrical wiring design can be increased.

High output is difficult with VCSEL. It is therefore also possible to increase lifespan of the light source by, for example, forming a single dot with a plurality of beams (high-density) and suppressing outputted light.

For example, with VCSEL's arrayed at a resolution of 4800 dpi, if dots are formed at 1200 dpi using four laser diodes, output of one laser diode can be reduced to a quarter.

It is also possible to reduce banding due to reciprocity by implementing "interlaced scanning ($L1>(k-1)\times L2$)".

Reciprocity becomes marked during high-density writing. The effect of reducing the reciprocity therefore also becomes more marked by implementing "interlaced scanning ($L1>(K-1)\times L2$)" for high-density writing so as to give, for example, $25.4/L2 \geqq 2400$.

The influence of reciprocity can be reduced as described above by carrying out interlaced scanning. However, it is also possible for these effects to be made more substantial by forming progressive scanning lines for all of the scanning lines of the surface to be scanned using deflection scanning differing with respect to time.

Next, an example of the case of averaging the scanning line intervals is described below as a second embodiment. In the event of:

Resolution: 4800 dpi

Figure 9:
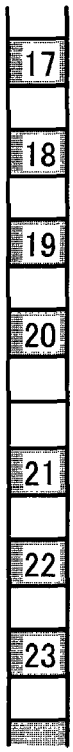
FIG. 9 is a diagram of an example arrangement for laser diodes depicting the first example when spacing of scanning lines is uneven in a second embodiment.
Figure 10A:
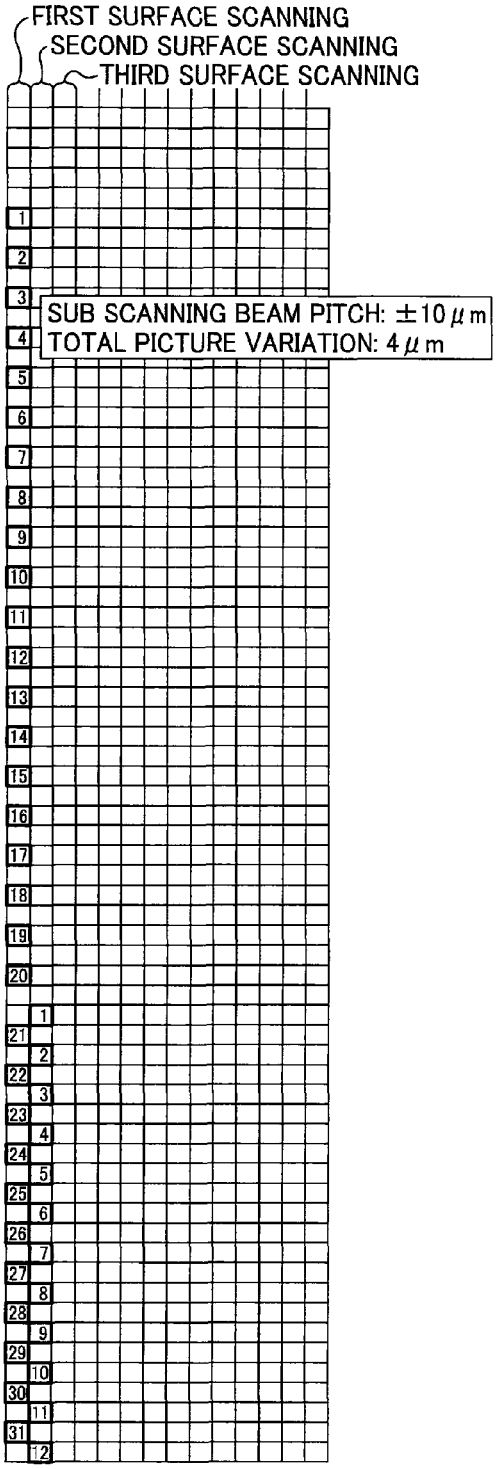
FIGS. 10A to 10D are diagrams for explaining scanning occurring in various writing methods.
Figure 10B:
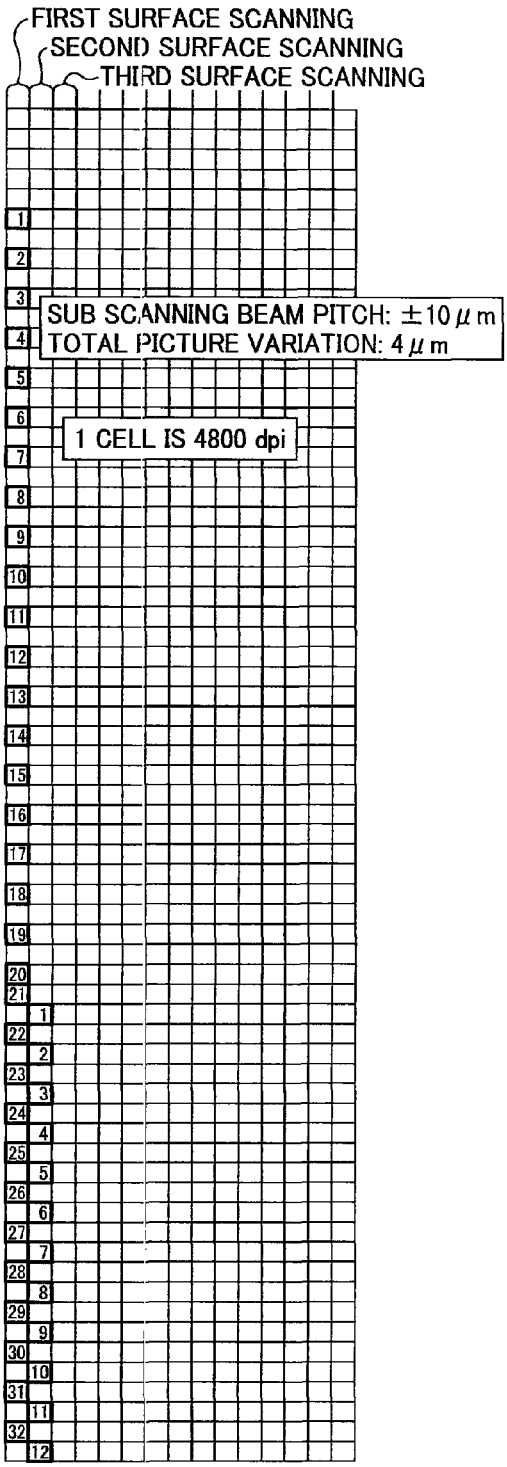
Figure 10C:
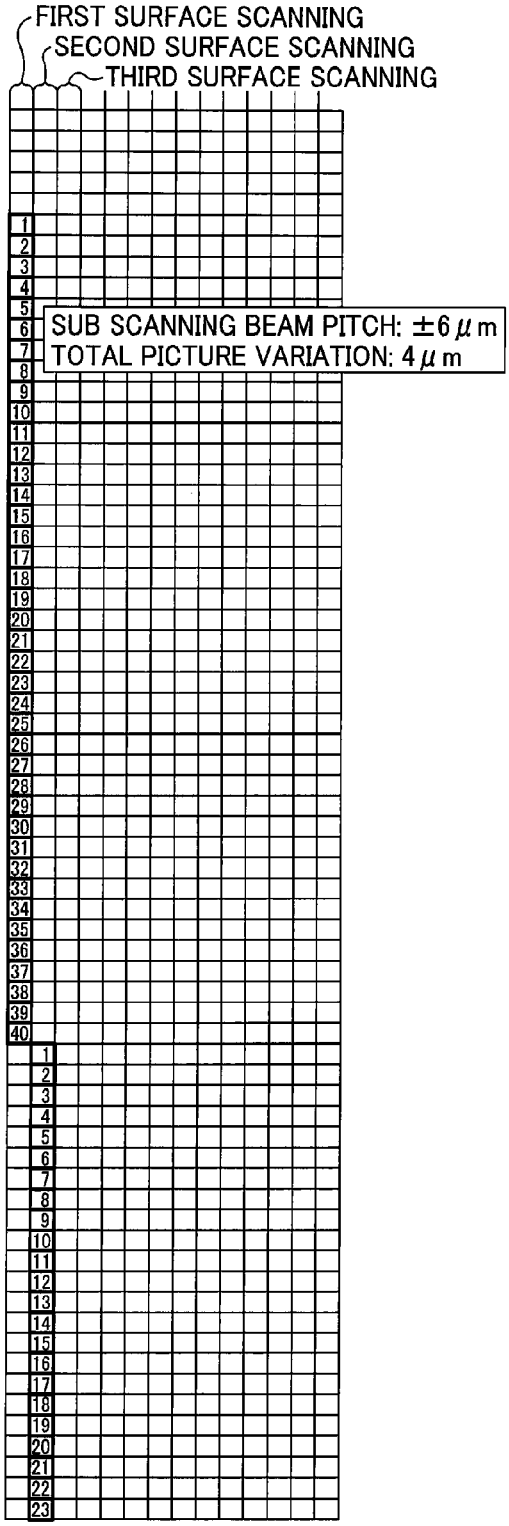
Figure 10D:
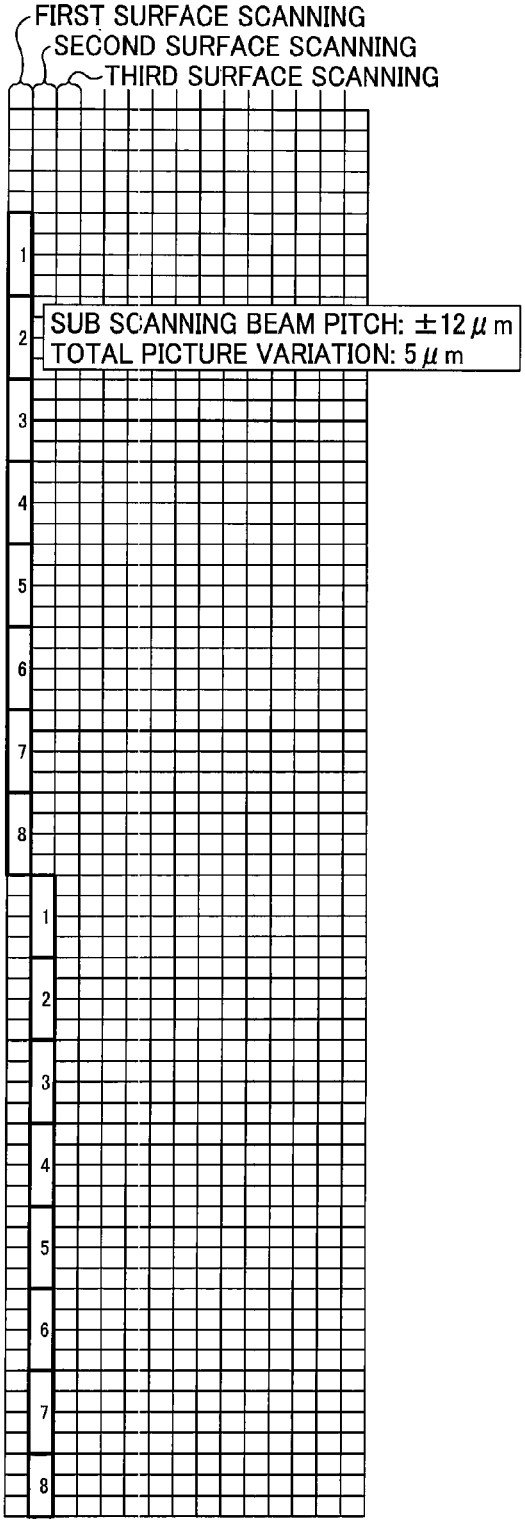

Number of laser diodes: 40 channels, the laser diode intervals are arranged every one dot. Several laser diode spacings vary during this time. For example, FIG. 9 explains an example of 20th and 21st laser diodes spaced by two dots.

A light source arrangement taking into consideration the thermal characteristics of the light sources is therefore possible as a result of this averaging. Such technology is referred to in Japanese Patent Application Laid-open No. 2006-215270. It is therefore possible to reduce variations due to the scanning locations of the laser diodes by adopting this averaging. Periodic noise can also be reduced and it can be ensured that variations in density are no longer striking.

Next, tests are performed on structures that influence improvements in density variation when the scanning line spacing is averaged (third embodiment).

As shown in the first embodiment, density variation when the writing method (VCSEL interlacing, progressive, multi-laser diode) is changed is evaluated.

Evaluation is carried out for writing methods of VCSEL interlacing (two types of scanning spacing averaging), progressive, and multi-laser diode (refer to FIG. 10).

In particular, in interlaced scanning (2), the spacing is narrow. Parallel scanning line spacing therefore becomes excessively broad and ensuring the optical characteristics becomes straightforward.

As with the first embodiment, the evaluation items are taken to be images evaluated at 1200 dpi, 2-dot horizontal lines (=4800 dpi, 8-dot horizontal lines).

Figure 11:
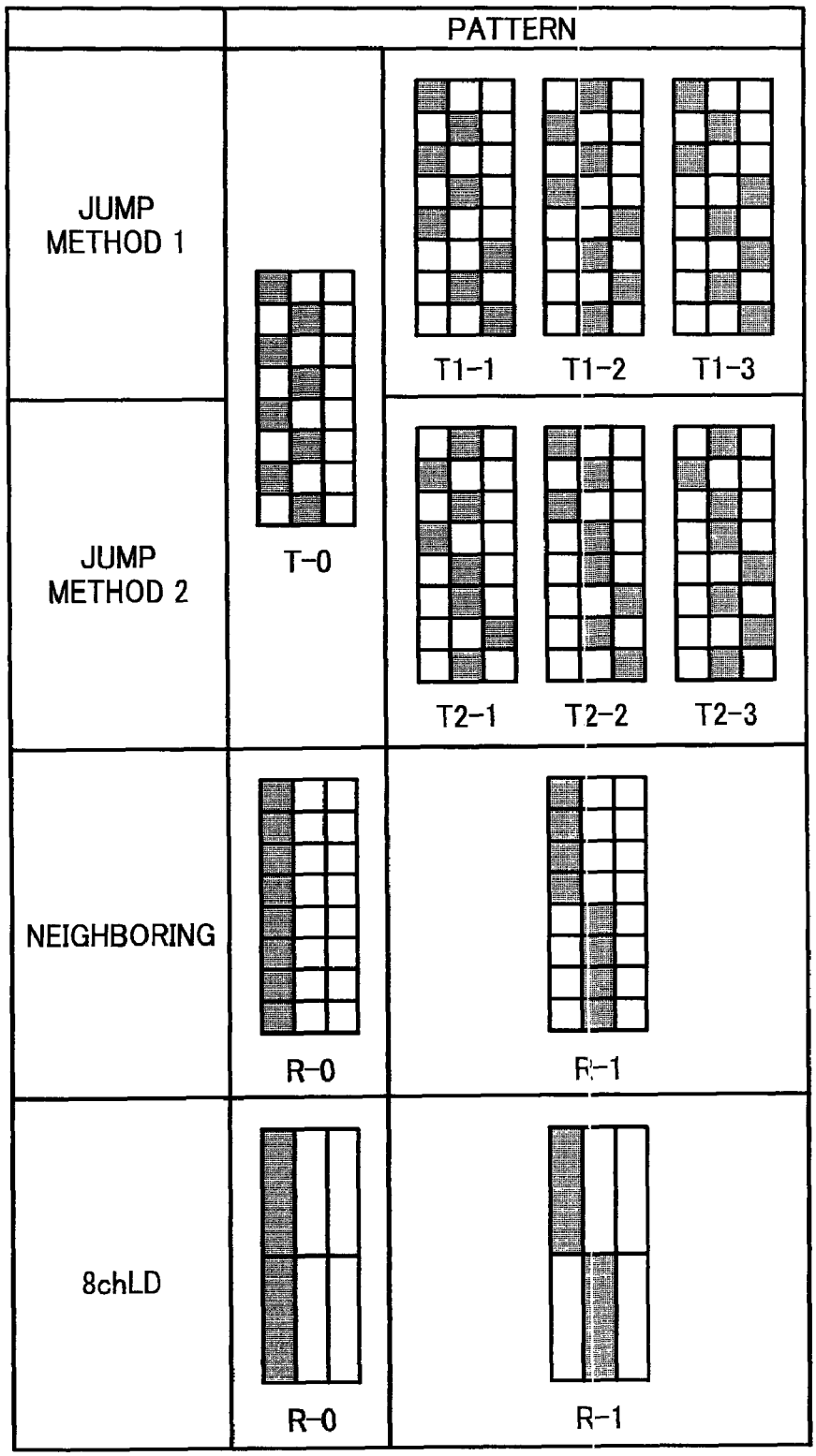
FIG. 11 is a diagram for explaining 1200 dpi, 2-dot line scanning examples for each writing method.

Examples of the number of times of scanning according to the writing method and the laser diode writing positions (including central parts of the VCSEL or ends, i.e. the scanning switching) during exposure of this evaluation image are shown in FIG. 11. A vertical side of each pattern is the sub-scanning position and the horizontal side is the scanning number.

Cases where the number of times of scanning are different similarly occur when an evaluation image is formed using the ends of laser diodes as with the first embodiment.

Figure 12:
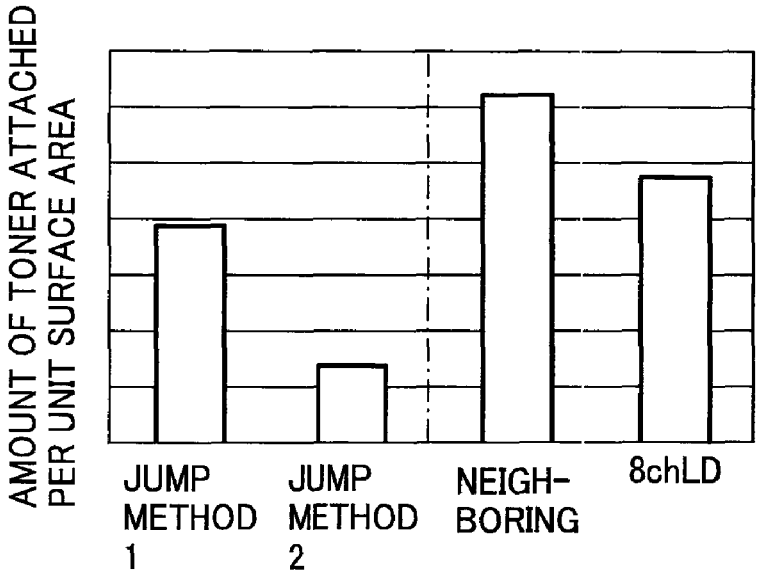
FIG. 12 is a graph for explaining differences in amounts of toner that become affixed in each writing method.
Figure 13:
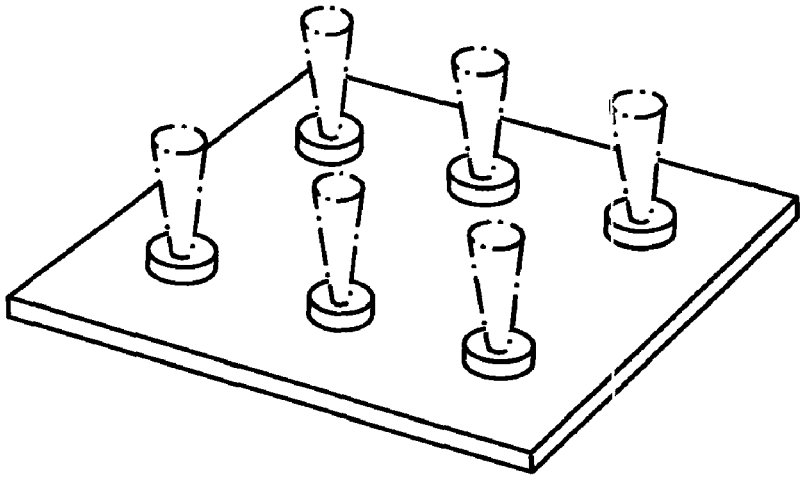
FIG. 13 is an outline perspective view for explaining VCSEL.
Figure 14:
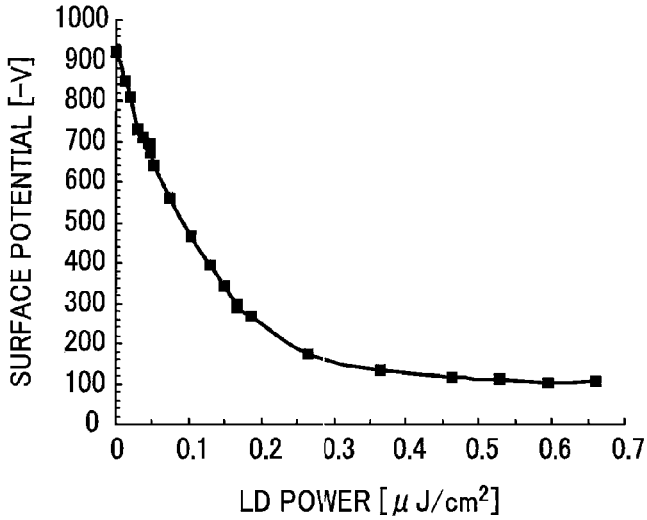
FIG. 14 is a light attenuation curve indicating an extent of attenuation of charge potential with respect to exposure energy.
Figure 15:
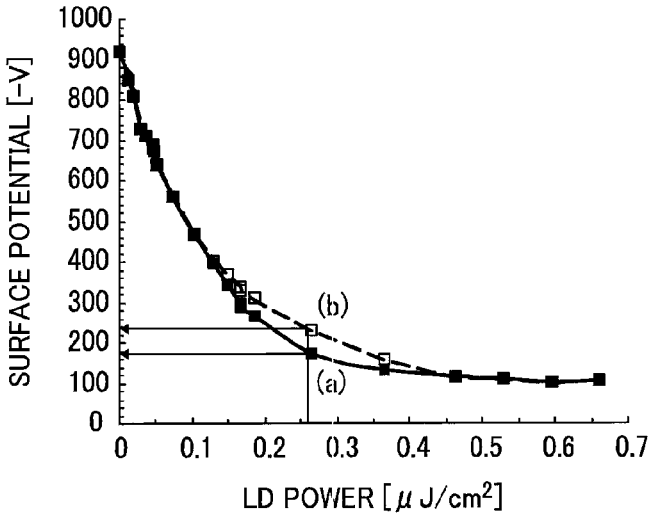
FIG. 15 is a light attenuation curve indicating the reciprocity law failure in the event of exposure to exposure energy two times.
Figure 16:
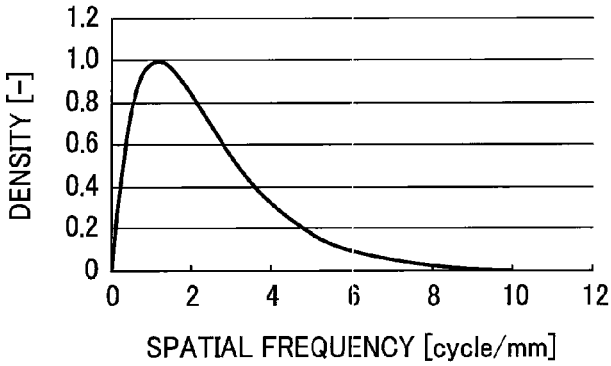
FIG. 16 is a graph for explaining spatial frequency characteristics of a visual perception system.

An example of comparing the amount of toner that becomes attached in the vicinity where variation occurs and the amount of toner that becomes attached at other locations is shown in FIG. 12. A small value means that the density variation is also small and it can be confirmed that interlaced scanning gives images of the smallest density variation.

When the scanning spacing is broadened and an image is formed by a plurality of scans as with interlaced scanning, images are formed using a plurality of scans because write density is low. The variation in density occurring at the ends of the laser diodes is therefore slight. In particular, with regards to interlaced scanning (2) where the laser diode spacing is narrow, it can be confirmed that density variation occurring at the ends of the laser diodes is slight.

Spacing of parallel scanning lines does not become excessively broad if it is ensured that scanning lines where the spacing becomes the most narrow of the spacing of the scanning lines formed by a one-time deflection scan are not at the ends in the sub-scanning direction. Confirmation of the optical characteristics therefore becomes more straightforward, it is possible to reduce variation due to laser diode scanning locations, and it is possible to ensure that variations in density are no longer striking.

The following is a description of the fourth embodiment.

In this embodiment, a beam diameter in a main scanning direction is taken to be Wm, a beam diameter in a sub-scanning direction is taken to the Ws, and it is taken that $Ws \leqq Wm$ is satisfied.

The beam diameter in the main scanning direction is typically set to be narrower than the beam diameter in the sub-scanning direction at the surface to be scanned.

The beam emitted from the surface emitting laser has a cross-section across the light axis close to being circular. The quantity of light can become insufficient when the width of the opening in the main scanning direction and the width in the sub-scanning direction are different, making implementation of high speeds difficult.

It is therefore possible to reduce the difference in the width of the main scanning direction and the width of the sub-scanning direction of the opening by making the beam width in the main scanning direction thicker than the beam width in the sub-scanning direction. It is then possible to increase coupling efficiency (the ratio of the power of light emitted from the opening with respect to the parent light emitted from the light emitting points).

It is also possible to achieve high resolution by making the surface emitting laser diodes multi-beam. The spacing between progressive scanning lines is short at this time. It is therefore possible to set a sub-scanning beam diameter to be thicker than progressive scanning line spacing. This makes it possible to bury images.

According to an aspect of the present invention, it is possible to make full use of the benefits of multi-beam scanning to bring about high quality images because variation such as density variation due to reciprocity is no longer striking.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical scanning device comprising:

a light source of surface emitting lasers arrayed two-dimensionally that emits a plurality of light beams;

a first optical system that guides the light beams from the light source in a first direction;

a deflection unit having a plurality of deflection surfaces that receive the light beams guided by the first optical system and deflect the light beams in a second direction; and a second optical system that guides the light beams deflected by the deflection unit toward a surface to be scanned, wherein when pixel density is taken to be n, number of the light beams is taken to be b, and number of the deflection surfaces is taken to be p, a spatial frequency S, denoted by: $S=1/((25.4/n)\times b\times p)$, is greater than or equal to 0.7 and less than or equal to 2.0, and when spacing between ends in a sub-scanning direction of a scanning line formed by one scan by the deflection unit is taken to be L1, and spacing between all progressive scanning lines at the surface to be scanned is taken to be L2, then: $L1>(k-1)\times L2$ is satisfied, where k is a total number of light emitting points of a light source.

2. The optical scanning device according to claim 1, wherein one dot of an image is formed as the result of overlapping of four or more beams arranged at the spacing L2 in the sub-scanning direction.

3. The optical scanning device according to claim 1, wherein $25.4/L2\geqq 2400$ is satisfied.

4. The optical scanning device according to claim 1, wherein progressive scanning lines of all of the scanning lines of the surface to be scanned are formed by deflection scanning that differs with respect to time.

5. The optical scanning device according to claim 1, wherein scanning line spacings vary, the spacings being formed by one deflection scanning with k light emitting points, where k is the total number of light emitting points.

6. The optical scanning device according to claim 5, wherein scanning lines of narrowest spacing of the spacings for scanning lines formed by one deflection scanning are not at either end in the sub-scanning direction.

7. The optical scanning device according to claim 1, wherein $Ws\leqq Wm$ is satisfied when a beam diameter in the main scanning direction is taken to be Wm and a beam diameter in the sub-scanning direction is taken to be Ws.

8. An image forming apparatus comprising:

an image carrier; and an optical scanning device that forms a latent image on a surface of the image carrier by scanning the surface, the optical scanning device including a light source of surface emitting lasers arrayed two-dimensionally that emits a plurality of light beams;

a first optical system that guides the light beams from the light source in a first direction;

a deflection unit having a plurality of deflection surfaces that receive the light beams guided by the first optical system and deflect the light beams in a second direction; and a second optical system that guides the light beams deflected by the deflection unit toward a surface to be scanned, wherein when pixel density is taken to be n, number of the light beams is taken to be b, and number of the deflection surfaces is taken to be p, a spatial frequency S, denoted by: $S=1/((25.4/n)\times b\times p)$, is greater than or equal to 0.7 and less than or equal to 2.0, and when spacing between ends in a sub-scanning direction of a scanning line formed by one scan by the deflection unit is taken to be L1, and spacing between all progressive scanning lines at the surface to be scanned is taken to be L2, then: $L1>(k-1)\times L2$ is satisfied, where k is a total number of light emitting points of a light source.

* * * * *